US006820705B2

(12) United States Patent
Baugh

(10) Patent No.: US 6,820,705 B2
(45) Date of Patent: Nov. 23, 2004

(54) FRICTION SUPPORT ASSEMBLY FOR A SLIP BOWL

(76) Inventor: Benton F. Baugh, 14626 Oak Bend, Houston, TX (US) 77079

( * ) Notice: Subject to any disclaimer, the term of this patent is extended or adjusted under 35 U.S.C. 154(b) by 3 days.

(21) Appl. No.: 10/372,503

(22) Filed: Feb. 24, 2003

(65) Prior Publication Data

US 2004/0163853 A1 Aug. 26, 2004

(51) Int. Cl.[7] ..... E21B 19/10; E21B 19/00

(52) U.S. Cl. ..... 175/423; 166/75.14; 166/77.53; 166/85.5; 166/382

(58) Field of Search ..... 166/381, 382, 166/75.11, 77.51, 77.53, 85.1, 85.5, 75.14; 175/5, 423

(56) References Cited

U.S. PATENT DOCUMENTS 2,259,460 A * 10/1941 Dexter ..... 464/90
2,286,593 A * 6/1942 Abegg ..... 464/163
4,269,277 A 5/1981 Baugh
4,275,487 A * 6/1981 Gray et al. ..... 188/67
4,324,194 A * 4/1982 Elliston ..... 114/264
4,332,062 A * 6/1982 Byrne, Jr. ..... 188/67
4,381,584 A * 5/1983 Coyle, Sr. ..... 188/67
4,411,456 A * 10/1983 Martin ..... 285/39
4,469,201 A * 9/1984 Rastetter et al. ..... 188/67
4,823,919 A * 4/1989 Hayatdavoudi ..... 188/67
4,949,786 A * 8/1990 Eckert et al. ..... 166/208
5,031,696 A * 7/1991 Zwiegel ..... 166/208
5,732,909 A * 3/1998 Sonnier ..... 248/49
5,992,801 A * 11/1999 Torres ..... 248/49
6,089,338 A * 7/2000 Bouligny, Jr. ..... 175/423
6,264,395 B1 * 7/2001 Allamon et al. ..... 403/367
6,279,662 B1 * 8/2001 Sonnier ..... 166/380
6,471,439 B2 * 10/2002 Allamon et al. ..... 403/374.1
2002/0061224 A1 * 5/2002 Allamon et al. ..... 403/374.1
2003/0173117 A1 * 9/2003 Mason et al. ..... 175/423

* cited by examiner

*Primary Examiner*—David Bagnell
*Assistant Examiner*—Jennifer H Gay

(57) ABSTRACT

A method of supporting an pipe in a bowl without marking the surface of the pipe by providing a pair of intermediate surfaces between the sloping surface of the bowl and the contact surface with the pipe. The intermediate surfaces are approximately perpendicular to each other in order to amplify the force against the pipe in comparison to the force from the bowl.

13 Claims, 3 Drawing Sheets

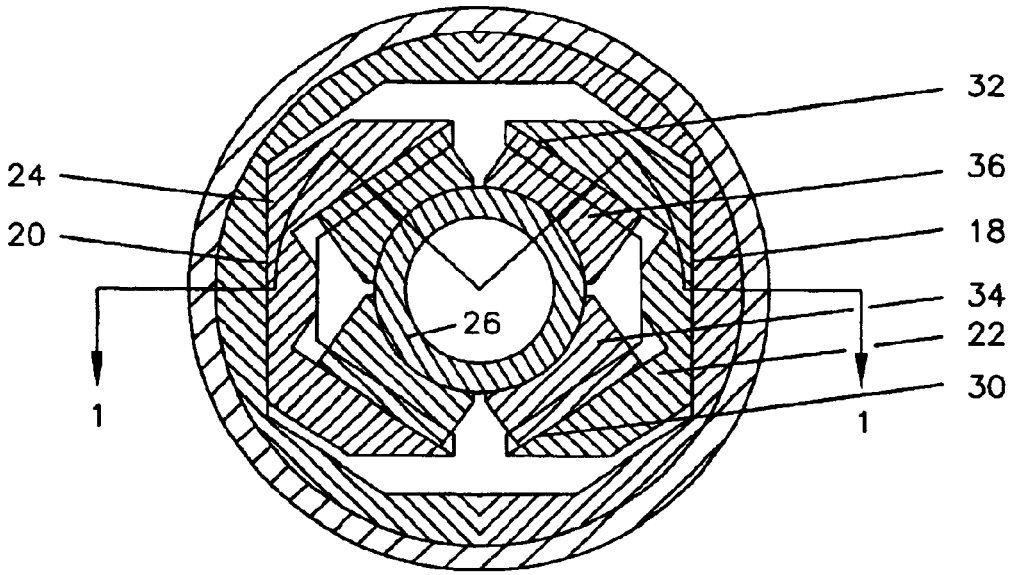
FIGURE NO. 2
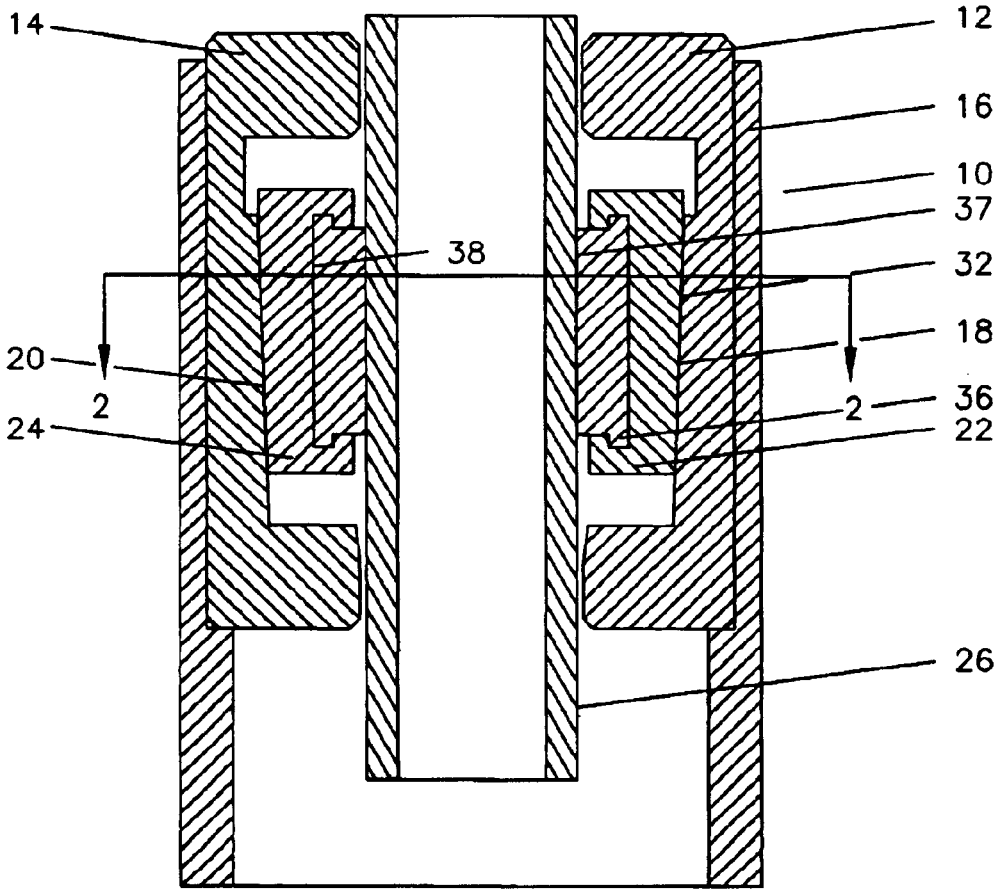
FIGURE NO. 1

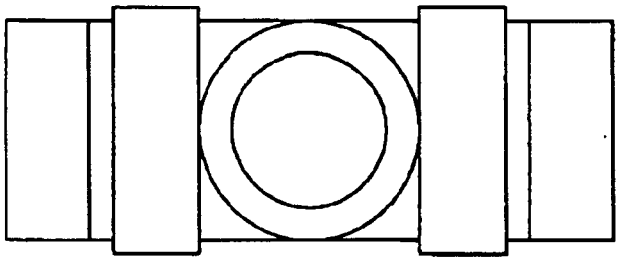
FIGURE NO. 3B
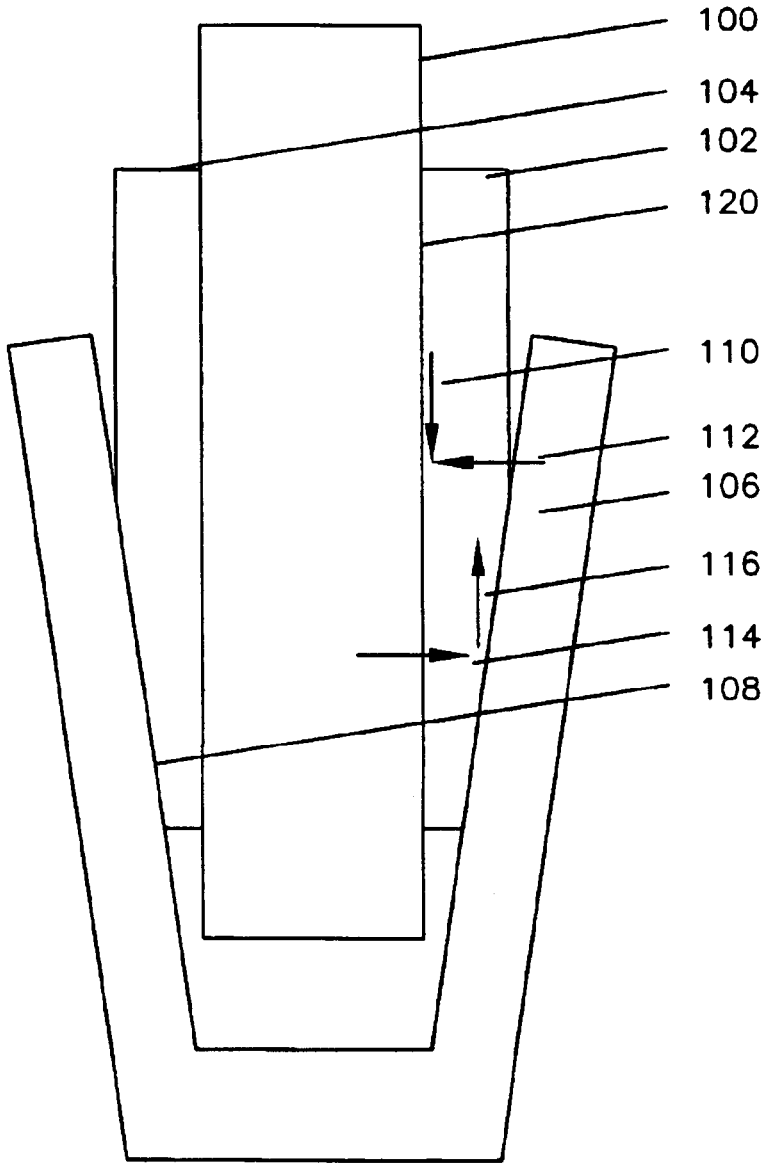
FIGURE NO. 3A

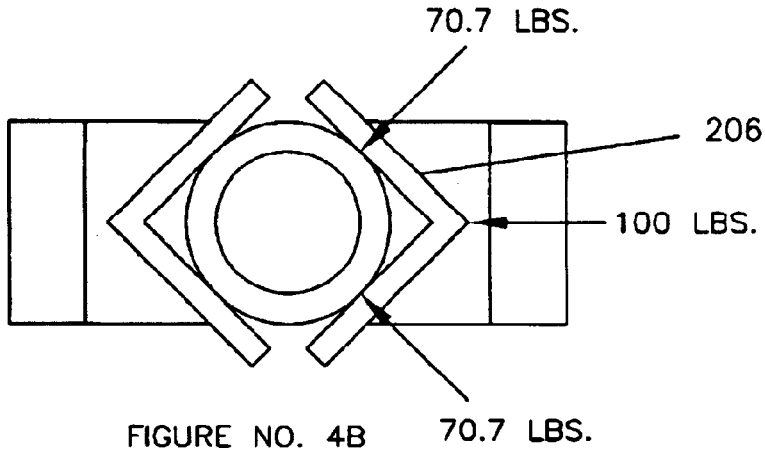
FIGURE NO. 4B
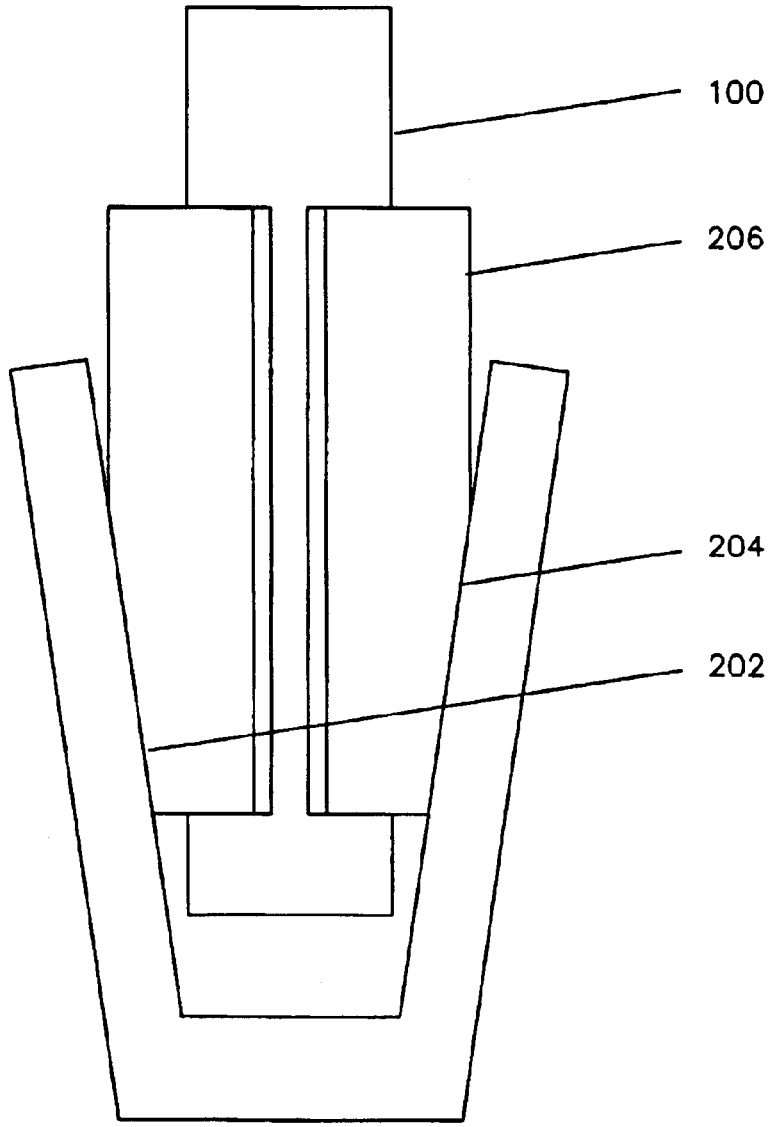
FIGURE NO. 4A

FRICTION SUPPORT ASSEMBLY FOR A SLIP BOWL

The present application claims priority to Provisional Patent Application Ser. No. 60/358,062 filed in the US Patent and Trademark Office on Feb. 19, 2002.

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

Friction support means in the oilfield are typically called "slips" and are a combination of a sharp toothed front profile for engaging a cylindrical pipe and a tapered back for engaging a tapered bowl. The more load the cylindrical pipe pulls down on the slips, the more they slip down the bowl and wedge more tightly against the pipe. It is inherent that in normal slips, the coefficient of friction against the pipe must be greater than the coefficient of friction against the tapered bowl, because the bowl angle provides a vertical component of force on the slip segments. The slip segment has the choice of slipping against the pipe or down the bowl, but the bowl has a tapered face looking up. With a similar coefficient of friction, the friction of the bowl wall plus the upwardly facing bowl exceeds the friction against the pipe.

The conventional means of providing the higher friction between the slip segments and the pipe is to provide sharp teeth which dig into the pipe wall, giving the equivalent of high friction with the wall. In many applications this is acceptable. In the case of laying of subsea pipelines with corrosion resistant coatings, the sharp teeth are not acceptable. The sharp teeth cut into and destroy the coatings.

BRIEF SUMMARY OF THE INVENTION

The object of this invention is to provide slip segments which will support pipe without defacing the exterior surface of the pipe.

A second object of the present invention is to provide slip segments which effectively provide a greater force against the supported pipe member than is provided (reacted) against the supporting bowl.

A third object of the present invention is to provide a mechanical advantage between the rear of a slip segment and the front of the slip to make the slip act as if the force on the front of the slip segments is greater than the force on the rear of the slip segments.

BRIEF DESCRIPTION OF SEVERAL VIEWS OF THE DRAWINGS

FIG. 1 is a half section of a slip of this invention taken along lines "1—1" of FIG. 2.

FIG. 2 is a section thru the slip assembly taken along lines "2—2" of FIG. 1.

FIG. 3 is a simplified 2 dimensional model of a conventional slip assembly.

FIG. 4 is a simplified diagrammatic model of the slip of this invention to show why it works.

DETAILED DESCRIPTION OF THE INVENTION

Referring now to FIG. 1, 10 is a slip assembly with two split bowl halves 12 and 14 sitting in a support ring 16. Split bowl half 12 has a sloping bowl surface 18 and split bowl half 14 has a sloping bowl surface 20. Slip carrier 22 has a sloping surface which engages sloping surface 18 and slip carrier 24 has a sloping surface which engages surface 20. Pipe 26 is supported by the slip assembly 10.

Referring now to FIG. 2, the slip carrier 22 is seen to have two internal profiles at 30 and 32 which support slips 34 and 36 respectively. The slips 34 and 36 engage the outer surface of the pipe 26 at slip front surfaces 37 and 38. In the figure the pipe is shown as round, however, other shapes such as square or hexagonal can be beneficially used.

Referring again to FIG. 1, internal profile 32 is shown supporting the slip 36 against vertical movement, except as slip carrier 22 moves vertically.

If internal profiles 30 and 32 were at 90 degrees and the system was frictionless, and a force of 100 lbs was exerted by the slip carrier against the split bowl half 12, the two internal profiles would exert a force of 70.7 (cosine 45 deg.) against the pipe, or a total of 141.4 lbs against the pipe due to the wedging effect of the angle.

Referring now to FIG. 3, a simple 2D model of a conventional slip assembly which was tested is shown. Basically a round pipe 100 is supported by having two wedges 102 and 104 going down sloping surfaces 106 and 108. As the pipe is pushed down (or pulled down by weight), there is a natural friction force 110 against the pipe, a combination of a normal force 112 times the coefficient of friction. The exact same force 114 is transmitted out against surfaces 106 and 108. However, because of the taper of surfaces 106 and 108, there is a resultant vertical component 116 of the force which is a combination of the friction force plus a trigonometric component. Basically, the force 116 urging the wedge up is greater than the force 110 urging the wedge down. This means that the pipe will not be supported by these wedges, but will rather slip under load.

The conventional solution to this is to put sharp teeth on the surface 120 which bite into the external surface of the pipe and effectively give a higher coefficient of friction to compensate for the problem with the angle on the back side of the wedge. This 2 dimensional example is shown for simplicity, but typical circular slips work in this exact same way.

Referring now to FIG., another tested configuration is shown. The sloping surfaces 202 and 204 are the same, and the pipe 204 is the same. However, instead of flat wedges, angle iron was used to make a wedging insert. As is shown, a 100 lbs. load on the center back of wedging insert 206 yields a 70.7 lbs. load on the two 90 degree surfaces for a total pipe loading of 141.4 lbs. Basically the back of the wedging insert is seeing only 100 lbs., but the pipe is acting as if it is seeing 141.4 lbs. As greater force is seen against the pipe than the back of the wedging insert, if the coefficient of frictions are the same on the front and the back, pushing the pipe down will cause the wedging insert to move down for increased wedging and therefore more wedging support.

Referring back now to FIG. 2, the wedging profile can be seen on profiles 30 and 32 of the slip carrier 22. The slips 34 and 36 engage the slip profiles 30 and 32, and provide an opposing face to engage the pipe 26. Profiles 30 and 32 provide a slip face such that when increasing wedging occurs due to increased loads, the front faces can always remain in good contact with the pipe. As profiles 30 and 32 have their own friction coefficients, the 90 degree wedging angle can be increased slightly to compensate for that friction and deliver loads directly into the pipe.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. A support assembly for supporting an elongated member within a bowl comprising:

one or more inclined surfaces within said bowl, one or more slip carriers engaging said one or more inclined surfaces, two or more slip segments engaging one of said slip carriers on first and second surfaces, said first and said second surfaces being approximately perpendicular to each other such that the force between said slip carrier and said bowl is amplified by the angles between said first surface and said second surface to provide a higher force against said elongated member than said slip carrier provides against said bowl.

2. The invention of claim 1, wherein said elongated member is round.

3. The invention of claim 2, wherein said elongated member is a pipe.

4. The invention of claim 1, wherein said elongated member is a pipeline to be laid on the sea floor.

5. The invention of claim 1, wherein the angle between said first surface and said second surface is less than ninety degrees.

6. The invention of claim 1, wherein the coefficient of friction between said elongated member and said slip segment is approximately the same as the coefficient of friction between said bowl and said slip carrier.

7. A support assembly for supporting an elongated member comprising a bowl member with one or more bowl sloping surfaces which slope from a distance further from said elongated member to closer to said elongated member, a slip member with one or more slip back surfaces to contact said sloping surfaces, two or more slip front surfaces to contact said elongated member, said two or more slip front surfaces having an approximately perpendicular angle between themselves such that the sum of the contact load between said slip front surfaces and said elongated member on one or more of said slip members exceeds the load between said slip back surface and said bowl sloping surface.

8. The invention of claim 7, wherein said slip back surfaces are sloping surfaces which generally conform to said bowl sloping surfaces.

9. The invention of claim 7, wherein said elongated member is round.

10. The invention of claim 9, wherein said elongated member is a pipe.

11. The invention of claim 7, wherein said elongated member is a pipeline to be laid on the sea floor.

12. The invention of claim 7, wherein the angle between said first surface and said second surface is less than ninety degrees.

13. The invention of claim 7, wherein the coefficient of friction between said elongated member and said slip segment is approximately the same as the coefficient of friction between said bowl and said slip carrier.

* * * * *